United States Patent [19]

Valley

[11] Patent Number: 4,728,133

[45] Date of Patent: Mar. 1, 1988

[54] DOOR HANDLE ATTACHMENT APPARATUS

[75] Inventor: Harold J. Valley, Mission Viejo, Calif.

[73] Assignee: Unatech, Escondido, Calif.

[21] Appl. No.: 741,447

[22] Filed: Jun. 5, 1985

[51] Int. Cl.[4] ..... E05C 21/00

[52] U.S. Cl. ..... 292/336.3; 292/350; 292/357; 292/DIG. 60

[58] Field of Search ..... 292/169.16, 336.3, 336.5, 292/356–358, 350, 352, 348, 353, DIG. 60; 70/452

[56] References Cited

U.S. PATENT DOCUMENTS

| | | | |
|---|---|---|---|
| 226,243 | 4/1880 | Parker . | |
| 305,426 | 9/1884 | Clark . | |
| 326,920 | 9/1885 | Russell, Jr. . | |
| 506,388 | 10/1893 | Clark | 292/350 X |
| 794,757 | 7/1905 | Voight . | |
| 1,100,232 | 6/1914 | De Wolfe | 292/358 |
| 1,164,958 | 12/1915 | Paton . | |
| 1,244,394 | 10/1917 | Winter . | |
| 1,451,829 | 4/1923 | Hubbard . | |
| 1,556,716 | 10/1925 | Robichaud | 292/348 |
| 1,877,289 | 9/1932 | Field | 292/352 |
| 2,080,174 | 5/1937 | Hart et al. | 292/358 X |
| 2,846,255 | 8/1958 | Wardwell | 292/357 X |
| 3,471,190 | 10/1969 | Wansbrough et al. | 292/348 X |
| 3,779,590 | 12/1973 | Sanders et al. | 292/336.3 |
| 4,343,502 | 8/1982 | Nelson | 292/356 |
| 4,471,984 | 9/1984 | Bellantuono | 292/358 X |
| 4,502,720 | 3/1985 | Fayerman et al. | 292/169.16 X |

FOREIGN PATENT DOCUMENTS

| | | | |
|---|---|---|---|
| 2418180 | 1/1975 | Fed. Rep. of Germany | 292/356 |
| 2418103 | 3/1975 | Fed. Rep. of Germany | 292/356 |
| 2378924 | 9/1978 | France | 292/356 |
| 2475101 | 8/1981 | France | 292/336.5 |

*Primary Examiner*—Richard E. Moore

*Attorney, Agent, or Firm*—Spensley, Horn, Jubas & Lubitz

[57] ABSTRACT

A door handle assembly for rotatably coupling a door handle to a spindle, latching mechanism, and a door. The assembly includes an adapter member connected to the door handle and slidingly receiving the spindle. A rosette associated with the spindle is sandwiched between the door handle and adapter member to provide rotatable coupling between the handle and the door. The assembly permits use of standardized length elements on doors of differing thicknesses.

6 Claims, 5 Drawing Figures

DOOR HANDLE ATTACHMENT APPARATUS

1. Field of the Invention

The present invention concerns door latching assemblies and more particularly an apparatus for coupling a door handle to a latching mechanism disposed within the door.

2. Background of the Invention

Conventional door latching assemblies typically include a latching mechanism partially disposed within a door, one or two door handles disposed on opposing sides of the door, and some type of appartus for coupling the handles to the latching mechanism. In addition, a pair of cover plates or rosettes may be attached on opposing sides of the door to cover the latching mechanism. These rosettes typically have an aperture through which the door handles project. Usually the handles are attached to the latching mechanism by a spindle projecting through the latching mechanism with the handles engaging the ends of the spindle. The handles and spindle are then commonly secured to one another by threading the spindle ends into appropriately threaded bores within each of the handles. To prevent rotation of the spindle with respect to the handle, a set screw may be threaded into the handle perpendicular to and in contact with the spindle. Usually rotation of the spindle by movement of the handle operates the latching mechanism.

Securing the handle to the latching mechanism by a threaded spindle, however, suffers from certain disadvantages. Since doors are manufactured in varying thicknesses, a number of spindles of differing length are usually required to engage the door handles at various distances from latching mechanisms disposed within the various doors. When a contractor is outfitting a building, for example, special care must often be taken to assure that an appropriate number of spindles of differing length have been obtained if the building has doors of differing thickness. Unnecessary delays in completing outfitting of the building can otherwise occur. Thus, there exists a need for a handle-latching mechanism securing apparatus which is adaptable to doors of differing thickness.

One approach to a handle-latching mechanism coupling apparatus adaptable to doors of differing thickness is described in U.S. Pat. No. 1,451,829. In this approach the door handle includes a knob attached to a cylinder having a longitudinally oriented threaded bore. An extended length spindle, engaging a locking mechanism, is threaded into the cylinder portion of the door handle. A greater or lesser portion of the spindle is disposed within the cylinder to accommodate variations in door thickness. This approach, however, requires that the cylinder portion of the door handle have a sufficient length to accommodate a substantial portion of the spindle when the assembly is used on a relatively thin door. Such an extended length door handle cylinder is generally considered aesthetically unappealing. Tnus, there still exists a need for a handle-latching mechanism coupling apparatus which is adaptable to doors differing in thickness and does not require a door handle of extended length to accommodate a substantial portion of a relatively long spindle.

SUMMARY OF THE INVENTION

It is therefore an object of the present invention to provide an improved apparatus for coupling a handle and latching mechanism which is able to accommodate doors of differing thicknesses. It is a further object of the present invention to provide a handle-latch mechanism coupling apparatus able to accommodate doors of differing thickness without requiring spindles of differing lengths or an extended length handle to receive a substantial portion of a spindle.

To accomplish these and other goals and objectives, the handle-latching mechanism coupling apparatus of the present invention includes a spindle engaging the latching mechanism and an adapter element having one end with a bore configured for receiving the spindle and a second end partially disposed within the handle. In the illustrated embodiment, rosettes are also provided on opposing sides of the door and sandwiched between the door handle and the adapter element. Variations in door thickness are accommodated by the extent to which a spindle of standardized length is received within the bore of the adapter element.

The novel features which are believed to be characteristic of the present invention, together with further objectives and advantages thereof, will be better understood from the following description considered in connection with the accompanying drawings wherein like numbers designate like elements. It should be expressly understood, however, that the drawings are for purposes of illustration and description only and are not intended as a definition of the limits of the invention.

DETAILED DESCRIPTION

Figure 1:
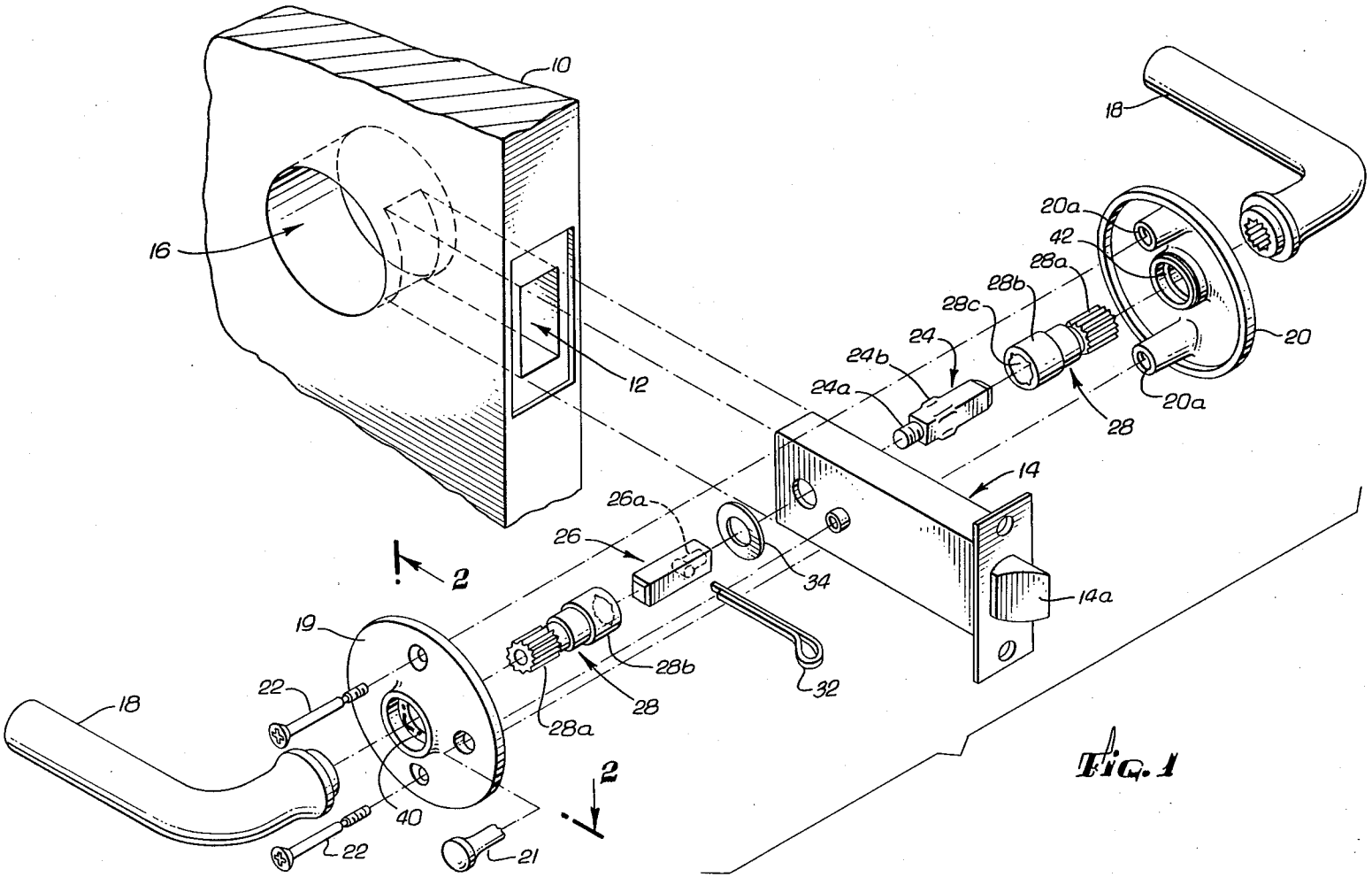
FIG. 1 is a general perspective exploded view of a door handle, latching mechanism, and an embodiment of the present inventive coupling apparatus.
Figure 2:
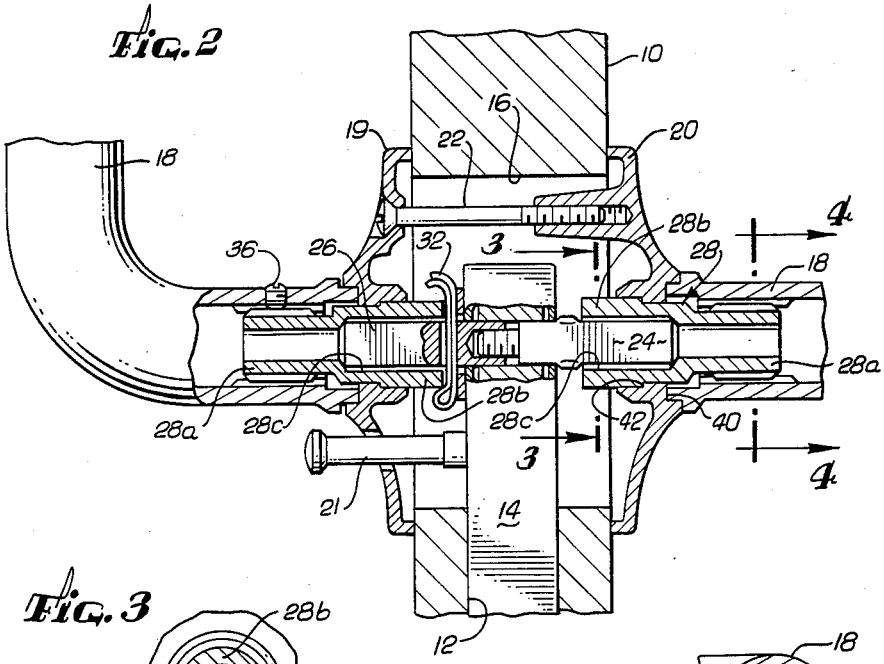
FIG. 2 is a cutaway side view along the line 2—2 in FIG. 1 of the door handle, latching mechanism, and coupling apparatus of FIG. 1 assembled on a relatively thin door.
Figure 3:
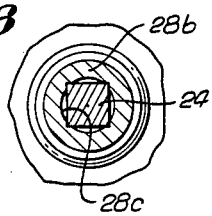
FIG. 3 is a cutaway side view along the line 3—3 in FIG. 2 of a spindle and adapter element of the coupling apparatus of FIG. 2.
Figure 4:
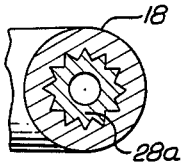
FIG. 4 is a cutaway end view along the line 4—4 in FIG. 2 of the door handle and adapter element of FIG. 2.

Referring to the drawings, and more particularly FIG. 1 thereof, there is shown an exploded view of a door latching assembly incorporating a preferred embodiment of the present inventive door handle coupling apparatus. As shown, a door 10 is typically provided with a cavity 12 for receiving a conventional latching mechanism 14. The door 10 is further provided with a bore 16 communicating with the cavity 12 within which the inventive door handle coupling apparatus is disposed. As shown in FIG. 2, the door handles 18 and matching rosettes 19, 20 are disposed on opposing ends of the bore 16. The rosettes 19, 20 are clamped to opposing sides of the door 10 by screws 22 passing through rosette 19 and threaded into a projecting portion **20*a* of the matching rosette 20. The latching mechanism 14 may be any of a variety of conventional mechanisms which utilize spindles. This latching mechanism 14 may be provided with a lock which is actuated by a pin 21**.

A pair of spindle elements 24, 26 are partially disposed within and project out of the latching mechanism 14. Both of the spindle elements 24, 26 are provided with a polygonal cross-sectional geometry, shown in the figures as rectangular, to rotationally engage internal elements within the latching mechanism 14. Rotation of the spindle elements 24, 26 retracts a latch **14*a* into the latching mechanism 14. Spindle element 24 is provided with a threaded portion 24*a* which is threaded into a correspondingly threaded bore 26*a* in spindle element 26. The spindle elements 24, 26 are first threaded together and then inserted through one side of the latching mechanism 14. Several projections 24*b* are circumferentially disposed about spindle element 24 to prevent the spindle element 24 from sliding entirely through the latching mechanism 14. A cotter pin 32 is placed through a bore in spindle element 26 to prevent longitudinal displacement of spindle elements 24, 26 from latching mechanism 14. A washer 34 may be disposed about spindle element 26 between the cotter pin 32 and latching mechanism 14** to alleviate friction and wear.

The two threaded spindle elements 24, 26 are employed in the preferred embodiment to accommodate a locking feature of the latching mechanism 14. Typically, latching mechanisms having a locking feature include a split cam within the latching mechanism to separately engage the respective spindle elements 24, 26. When the latching mechanism 14 is locked, one cam portion associated with an "unlocked side" of the door 10 is allowed to rotate while the other cam portion assocaited with the "locked side" of the door is rotatably restrained. In the preferred embodiment, for example, spindle element 26 would be free to rotate while spindle element 24 would be rotatably fixed when latching mechanism 14 is locked. Spindle elements 24, 26 will thus rotate with respect to one another if the latching mechanism 14 is locked and the door 10 is opened from the "unlocked side." When latching mechanism 14 does not include a locking feature, a unitary structure spindle element could, of course, be used instead of the two spindle elements 24, 26.

The handles 18 are coupled to spindle elements 24, 26 by the adapter elements 28. Each of these adapter elements 28 has a first portion **28*a* to be disposed within the handles 18 and a second portion 28*b* with a bore 28*c* configured correspondingly to the cross-sectional geometry of the spindle elements 24, 26. As shown more clearly in FIGS. 2, 5, the adapter first portions 28*a* are inserted in the handles 18 with the adapter second portions 28*b*, disposed within the bore 16 of the door 10, receiving the projecting ends of the spindle elements 24, 26. By comparing FIGS. 2 and 5, it can be seen that a greater or lesser portion of the spindle elements 24, 26 are received within the bores 28*c* of the adapter second portions 28*b* depending on the relative thickness of the door 10 of FIG. 2 or door 10*a* of FIG. 5. Thus, variations in door thickness are accommodated in the present inventive door handle attachment apparatus without requiring a variety of spindles of differing length and without requiring extended length handles 18**.

Figure 5:
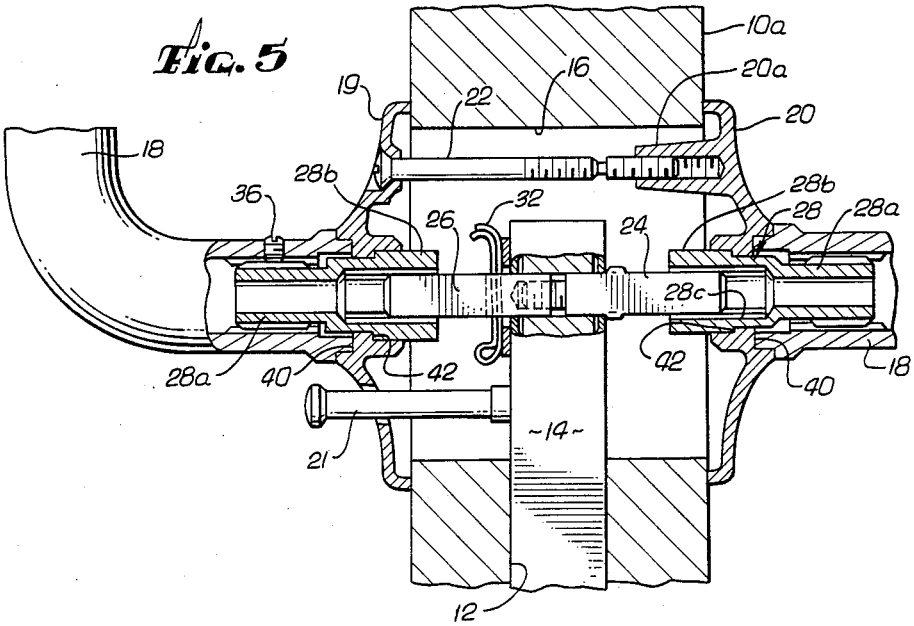
FIG. 5 is a cutaway side view along the line 2—2 in FIG. 1 of the door handle, latching mechanism, and coupling apparatus of FIG. 1 assembled on a relatively thick door.

In the illustrated embodiment, the adapter first ends **28*a* and the bores of the door handles 18 are correspondingly splined to prevent rotation of the adapters 28 with respect to the handles 18. As shown in FIGS. 2, 5, a set screw 36 may be threaded through the handle 18 into contact with the adapter 28 to prevent longitudinal displacement of the handle 18 from the adapter 28. When door handles having a generally "L" shaped configuration are used, as illustrated in FIG. 1, conventional latching mechanisms 14 fatigue over a period of time, thereby allowing the handle to sag. This sagging can be alleviated in the preferred embodiment by loosening the set screw and removing the handle 18 from the adapter to reorient the handle 18 with respect to the adapter 28. Where handle sagging is not a problem, as with door handles having a more symmetric shape, the handle 18 could simply be secured to the adapter 28** with a suitable adhesive.

As shown in FIGS. 2, 5, the rosettes 19, 20 are sandwiched between the handles 18 and adapters 28, and rotatably secure the handles 18 and adapters 28 to the door 10 or **10*a*. Each rosette 19, 20 is provided with an outward facing recessed aperture face 40 within which the handles 18 are rotatably seated. The rosettes 19, 20 are similarly provided with inwardly facing recessed apertures faces 42 and the adapter second portions 28*b* configured with corresponding first and second outer diameters to rotatably seat the adapters 28 on the inner face 42 of the rosettes 19, 20. Thus, the door handles 18 and adapters 28 are securely held with respect to the door 10 when the rosettes 19, 20 are clamped on opposing sides of the door by screws 22 or 22*a*. Clamping the rosettes 19, 20 about the door 10 or 10*a* further prevents longitudinal displacement of the adapters 28 from the ends of the spindle elements 24, 26**.

It will, of course, be understood that modifications of the present inventive door handle attachment apparatus, and its various aspects, will be apparent to those skilled in the art, some being apparent only after study and others being merely matters of routine mechanical design. For example, the adapter first ends **28*a* and door handle bores could be correspondingly configured with polygonally shaped cross-sectional geometries instead of splined. As discussed above, the mating spindle elements 24, 26** could be replaced with a unitary structure spindle. Thus, the scope of the present invention should not be limited by the particular embodiments herein described, but should be defined only by the appended claims and equivalents thereof.

What is claimed is:

1. A door handle apparatus actuating a latching mechanism in a door, comprising:

a spindle having first and second ends, said first end extending into said mechanism and having means thereat for engaging said mechanism and for applying a turning moment thereto, said second end defining a non-circular cross-sectional geometry and projecting outwardly from said mechanism;

a rosette mounted to said door, said rosette having a cylindrical aperture therethrough and outward-facing and inward-facing recessed aperture faces on opposite sides thereof, said aperture being disposed concentrically with respect to said spindle with said inward-facing recessed aperture face disposed at a predetermined position away from said door;

an adapter slidably disposed on said second end of said spindle between said mechanism and said rosette, said adapter having first and second cylindrical portions, said first portion having first and second outer diameters rotatably seated on said inward-facing recessed aperture face of said rosette and an axial bore defining a non-circular cross-sectional geometry generally conforming to that of said spindle second end, said bore slidingly receiving said end therein to a depth adjustable to seat said adapter in said rosette in doors of varying thickness, said second portion extending through said aperture and having an exterior surface defining a plurality of longitudinal splines;

a door handle disposed on said second portion of said adapter with said rosette sandwiched between said handle and said adapter, said handle being rotatably seated within said outward-facing recessed face of said rosette and having a bore therein, said bore defining a splined interior surface generally conforming to said splined exterior surface of said adapter second portion and slidingly-receiving said portion therein in one of a plurality of relative angular positions; and means for securing said handle longitudinally on said adapter second portion in said one relative angular position.

2. The apparatus of claim 1, wherein said means for securing said handle to said adapter further comprise:

a setscrew threaded through said handle in a direction generally perpendicular to said adapter and in contact with said adapter second portion.

3. The apparatus of claim 1, wherein said means for securing said handle to said adapter further comprise:

an adhesive bonding said handle to said adapter second portion.

4. A door handle apparatus actuating a latching mechanism in a door, comprising:

a spindle inserted longitudinally through said mechanism, said spindle having two ends and means therebetween for engaging said mechanism and applying a turning moment thereto, each said end defining a non-circular cross-sectional geometry and projecting outwardly from an opposite side of said mechanism;

a pair of rosettes mounted on opposite sides of said door, each said rosette having a cylindrical aperture therethrough and respective outward-facing and inward-facing recessed aperture faces on opposite sides thereof, each said aperture being disposed concentrically with respect to said spindle with said respective inward-facing recessed aperture faces disposed at predetermined positions away from said door;

a pair of adapters, each slidably-disposed upon an opposite, corresponding end of said spindle between said mechanism and a corresponding rosette, each said adapter having respective first and second cylindrical portions, said respective first portions having first and second diameters rotatably seated on an inward-facing recessed aperture face of said corresponding rosette and an axial bore defining a non-circular cross-sectional geometry generally conforming to that of said corresponding spindle second end, each said bore slidingly receiving said corresponding end therein to a depth adjustable to seat each said adapter in said corresponding rosette in doors of varying thickness, each said second portion extending through a corresponding aperture and having an exterior surface defining a plurality of longitudinal splines;

a pair of door handles, each disposed on a corresponding second portion of one of said adapters and having a cylindrical end rotatably seated within a corresponding outward-facing recessed aperture face with said corresponding rosette sandwiched between said handle and said corresponding adapter, each said handle end defining a bore having a splined interior surface generally conforming to said splined exterior surface of said corresponding adapter second portion and slidingly-receiving said portion therein in one of a plurality of relative angular positions; and means for securing each said handle longitudinally on said corresponding adapter second portion in said one position.

5. The apparatus of claim 4, wherein said means for securing each said handle further comprise:

a setscrew passing through said handle and in contact with said adapter second portion.

6. The apparatus of claim 4, wherein said means for securing each said handle further comprise:

an adhesive bonding said handle to said adapter second portion.

* * * * *